United States Patent [19]

Sherman

[11] Patent Number: 5,069,514

[45] Date of Patent: Dec. 3, 1991

[54] PANTY HOSE STORAGE DEVICE

[76] Inventor: Laura Sherman, 33 W. 81st St., New York, N.Y. 10024

[21] Appl. No.: 663,470

[22] Filed: Mar. 4, 1991

[51] Int. Cl.[5] ..... A47B 88/00

[52] U.S. Cl. ..... 312/348.3

[58] Field of Search ..... 312/348.3; 220/529, 220/530

[56] References Cited

U.S. PATENT DOCUMENTS

| | | | |
|---|---|---|---|
| 1,688.887 | 10/1928 | Spreen | 220/552 X |
| 2,268,637 | 1/1942 | Bernstein | 312/348.3 |
| 3,491,909 | 1/1970 | Ikelheimer | 220/529 |
| 3,715,280 | 2/1973 | Farmer | 220/529 |
| 3,837,560 | 9/1974 | Kuchuris et al. | 220/552 X |

*Primary Examiner*—Joseph Falk

*Attorney, Agent, or Firm*—Cobrin, Feingertz & Gittes

[57] ABSTRACT

A storage device for panty hose that can be placed in a dresser drawer and will hold a plurality of panty hose in a compact, orderly and attractive fashion. The storage device includes perpendicular partition members which form compartments and which members can be collapsed when not being used to store panty hose.

2 Claims, 2 Drawing Sheets

FIG. 3
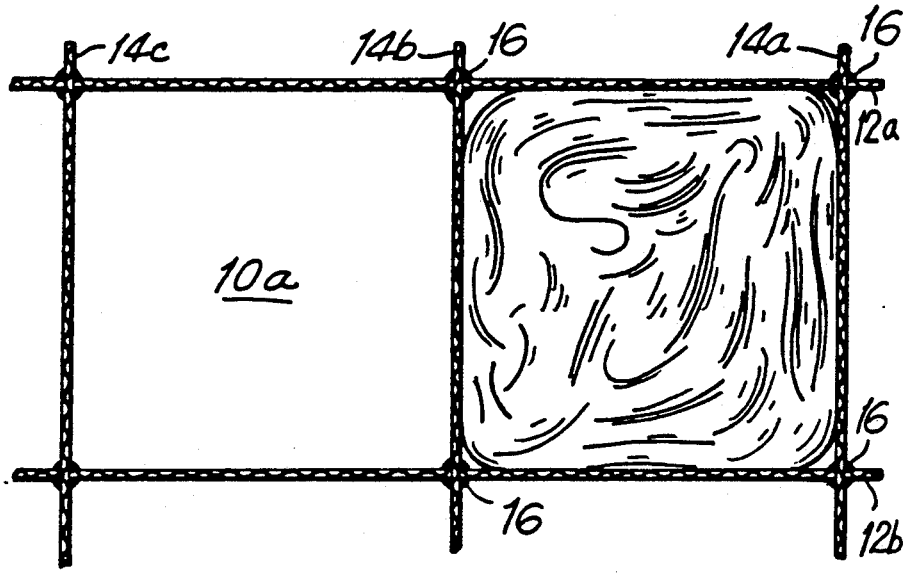
FIG. 4
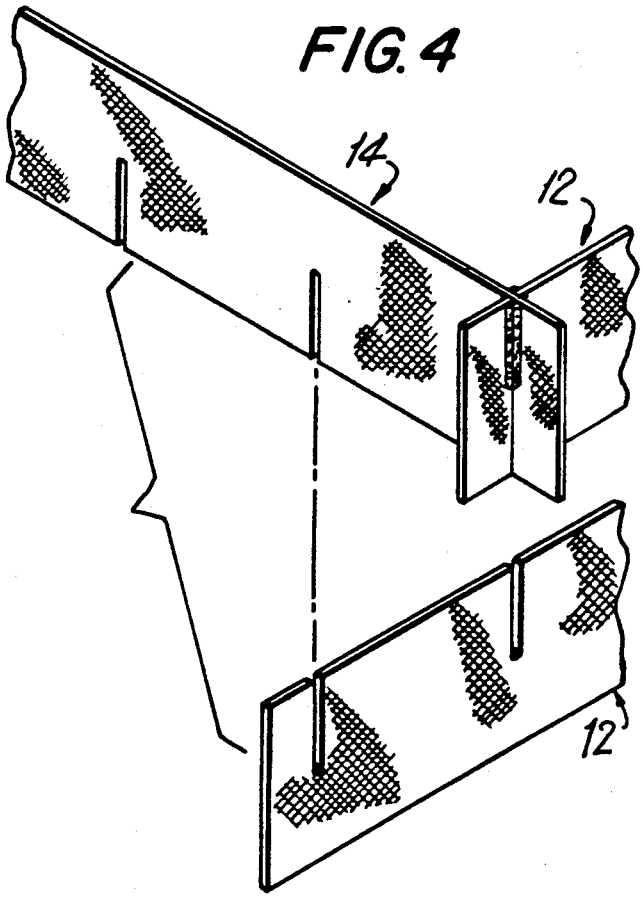
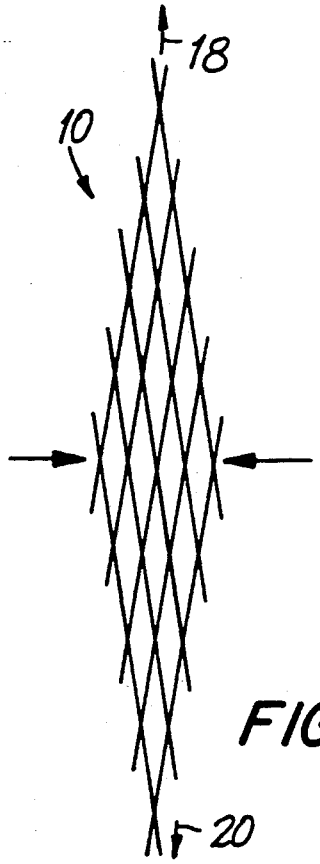
FIG. 5

PANTY HOSE STORAGE DEVICE

BACKGROUND OF THE INVENTION

This invention relates to a storage device for panty hose and particularly to a storage device for panty hose that can be placed in a dresser drawer and which will hold a plurality of panty hose in a neat, orderly fashion so they can be removed one at a time as required.

Nearly all women wear some type of panty which may loosely be defined as a woman's or child's undergarment covering the lower trunk and made with a closed crotch. In addition, many women and young ladies wear hosiery which is a cloth leg covering that, in most instances, covers the foot and extends either above or below the woman's knee. Hosiery serves the purpose of keeping the woman's leg warm while providing a covering for her foot.

In order to prevent hosiery from succumbing to the effects of gravity and sliding down a woman's leg, some means must be provided for holding the hosiery in a upright fashion. Heretofore, this was accomplished by means of a garter belt or a panty girdle.

Now, many woman use panty hose which eliminates the need for a garter belt or panty girdle because the panty and hosiery are of one-piece construction.

Normally, a woman stores several panty hose in her dresser drawer and removes one each day as required. However, this has led to a problem in that, after being worn once, panty hose do not fold well and take up an excessive amount of space when stored in a dresser drawer.

Aside from being messy and not neat, a pile of clothing in a woman's dresser drawer which includes panty hose creates an appearance of sloppiness which to some women is offensive and distasteful. Further, various pairs of panty hose can become entangled, making it difficult to find a specific pair or to even know the number and type of hose contained in the drawer, and other items in the drawer, or the corners and edges of the drawer themselves, frequently snag the panty hose, causing them to run, which renders them useless.

Yet another difficulty is that dresser drawers are frequently deep and not well adapted to store items that cannot be neatly stacked.

Still further, some women find it desirable to maintain their panty hose in one specific location in neat piles within their dresser drawer separate and apart from the other articles of clothing maintained in that dresser drawer.

It is also recognized that any panty hose storage device, when being used in a dresser drawer, would of necessity have to occupy a substantial volume of space so that it would have a plurality of compartments with each compartment storing an individual panty hose. However, when it is desired to remove a panty hose storage device from a dresser drawer and store it in another location during periods of non-use, the panty hose storage device should occupy a minimum amount of space.

It is, therefore, an object of the present invention to provide a storage device for storing panty hose in a neat, orderly fashion in a dresser drawer, which keeps to a minimum the space occupied by each pair of panty hose.

A further object of the present invention is to provide a panty hose storage device which, when not being used, will occupy a minimum amount of space. The flattening aspect of the design is also significant because it makes it easy to ship and to store at warehouses and retail locations.

Still a further object of the present invention is to provide a panty hose storage device which is easily used for storing panty hose and which is inexpensive in construction so that the cost of the same will not be an impediment to its widespread distribution and use.

Still a further object of the present invention is to provide a panty hose storage device which can be used in a woman's dresser drawer so as to store panty hose in a neat orderly fashion and yet can be made aesthetically pleasing.

Still a further object of the present invention is to compress each pair of panty hose so as to fit in as small a space as possible, to maximize the user's useful drawer space and to overcome the inherent tendency of the panty hose to expand to the available area.

A further object of the present invention is to provide a storage device for panty hose which can also be used to store hosiery, socks and other small articles of clothing.

The foregoing, as well as other objects, are accomplished by a panty hose storage device which consists of a first group of partition members. The partition members in the first group are identical to each other in configuration and are parallel to each other yet spaced apart from each other when positioned for storing panty hose. A second group of partition members, preferably but not necessarily equal in number to the first group of partition members, is provided and each partition member in the second group of partition members is spaced apart and parallel to the other partition members in the second set of partition members.

Each of the partition members in the first and second groups of partition members is made from a material that is self-sustaining—i.e., that is able to support its own weight. It has been found in practicing the present invention that a material suitable for constructing the partition members is conventional fabric which is stiffened by use of dilute fabric stiffener. Other means of stiffening may be used—e.g., sizing, plastic coating, etc.

The partition members in the first group of partition members each include a vertical cut in their uppermost portion with the number of vertical cuts corresponding to the number of partition members in the first and second groups of partition members. In a similar fashion, the second group of partition members include a vertical cut in the lowermost portion thereof, which vertical cuts for a particular partition member equal the number of partition members in the first and second groups of partition members.

The partition members are connected to each other by having the second group of partition members' vertical cuts extend over the vertical cuts of the partition members in the first group so that a portion of the partition members in the second group surrounds the partition members of the first group and vice versa. Thus, a number of flexible hinged joints are formed between the respective partition members in the first and second groups and glue is used to maintain the integrity of selected ones of the partition member joints. In practicing the present invention, other means might be used—i.e., stiffer fabric—precluding the need for glue.

By reason of interleaving the partition members as just described compartments are formed between respective portions of partition members and a panty hose can be stored in each such compartment in a neat and orderly fashion. In addition, a decoration may be placed on the fabric which makes the panty hose storage device attractive in appearance.

The panty hose storage device may be collapsed by pulling on opposite ends thereof so that when not used in a woman's dresser drawer it can be stored in an out of the way location without occupying substantial space.

Other objects of the invention will be apparent upon a review of the drawings and a review of the following specification.

THE DRAWINGS

FIG. 3 is a sectional view taken along the line 3—3 of FIG. 2;

FIG. 4 is an exploded view showing how the partition members of the present invention cooperate with each other; and FIG. 5 is a schematic representation illustrating how the present invention may be placed into a collapsed form.

DETAILED DESCRIPTION OF THE PREFERRED EMBODIMENT

Figure 1:
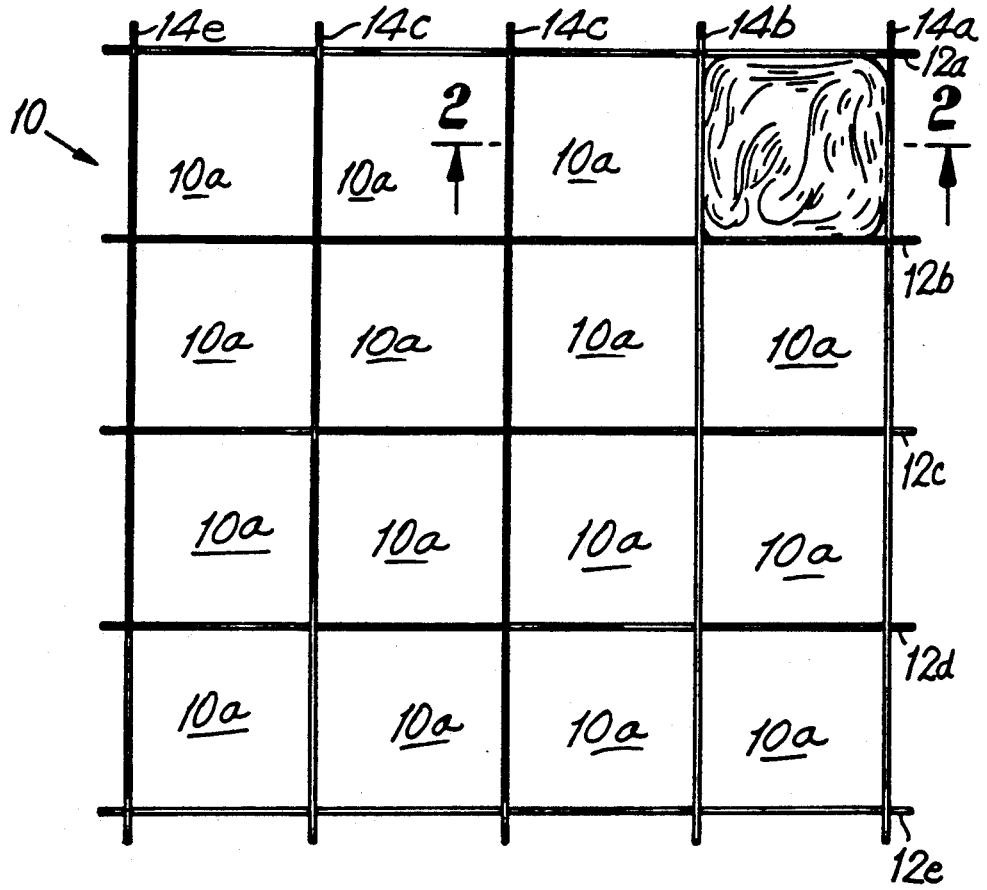
FIG. 1 is a top plan view of the panty hose storage device of the present invention.
Figure 2:
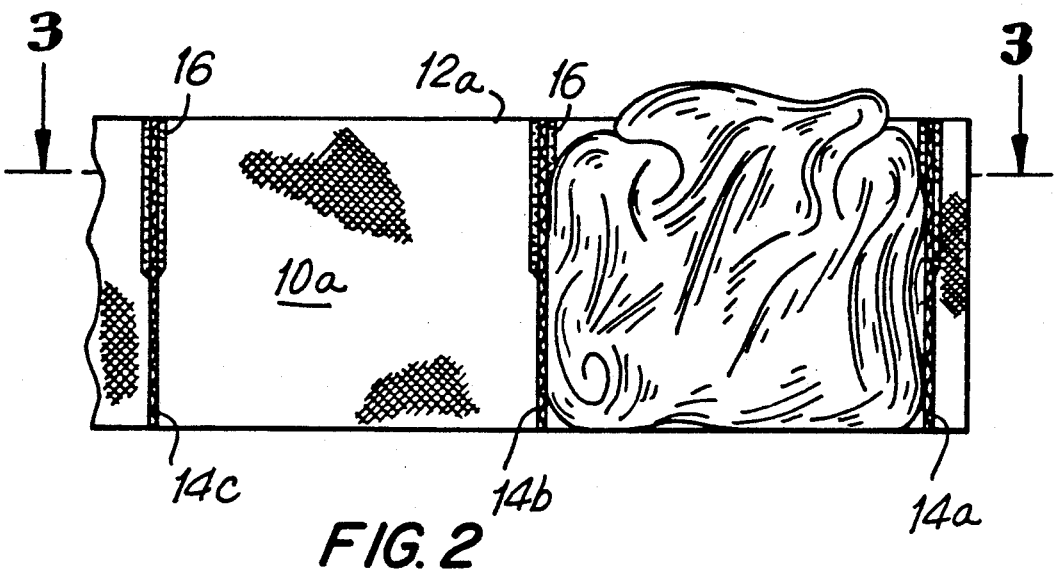
FIG. 2 is a sectional view taken along the line 2—2 of FIG. 1.

In FIG. 1 of the drawings, a panty hose storage device 10 according to the present invention is shown. The panty hose storage device 10 includes a plurality of compartments 10*a*, with each compartment adapted to receive an individual panty hose which can be stored therein separate and spaced from any other panty hose. While sixteen compartments are shown in the embodiment of the drawings, it is to be understood that this is for illustrative purposes only.

Panty hose storage device 10 includes a first group of partition members 12*a*, 12*b*, 12*c*, 12*d* and 12*e*. Each of the partition members bearing the reference numeral 12 are identical to each other, parallel to the other partition members in the group and spaced apart from each other when the storage device assumes the position shown in FIG. 1. The partition members 12 are preferably made of a fabric which has been stiffened by means of a commercial fabric stiffener such that they are self-supporting—i.e., they will not collapse under their own weight. Each of partition members 12*a*, 12*b*, 12*c*, 12*d* and 12*e* includes a vertical cut which extends from the top end of the partition member to a point approximately halfway towards the bottom thereof. This perhaps can best be seen in FIG. 4. There are five vertical cuts in each of partition members 12*a*, 12*b*, 12*c*, 12*d* and 12*e* and each of the vertical cuts serves a function that will hereinafter be described. The number of vertical cuts in a partition member equal the number of partition members in the first group.

The panty hose storage device of the present invention also includes a second group of partition members which group is identified as partition members 14*a*, 14*b*, 14*c*, 14*d* and 14*e*. Each of the partition members in the second group of partition members is spaced apart from the other partition members in the second group while being parallel to the other partition members in that group. Each partition member in the second group of partition members is perpendicular to the partition members in the first group of partition members with the storage device as shown in FIG. 1.

Partition members in the group identified by reference numeral 14 each include a vertically upwardly extending cut which can be seen in FIG. 4. The vertical cut in partition members 14 extends approximately to the mid-point of the height of the partition members which comprise the second group of partition members.

The partition members in the second group of partition members are likewise made of a fabric stiffened by a commercially available fabric stiffener.

When assembled, the partition members are as shown in FIG. 1 with the partition members in the first group which consists of partition members 12*a*, 12*b*, 12*c*, 12*d* and 12*e* spaced apart from each other, parallel to each other and perpendicular to the spaced apart parallel partition members in the second group of partition members which are identified as reference numerals 14*a*, 14*b*, 14*c*, 14*d* and 14*e*. In addition, each vertical cut in the first group of partition members cooperates and receives a vertical cut from a partition member in the second group of partition members such that, as shown in FIG. 4, interleaving of the respective partition members is formed so that each of the vertical cuts in each partition member in the second group of partition members slides into a vertical cut in the partition member of the first group so that four joints are formed about each compartment.

As can be seen in FIG. 3, a commercial glue 16 is used at each joint to attach the respective portions of adjacent partition members which form said joint to each other.

If desired, more partition members can be utilized than are shown in FIG. 3 so that more compartments are formed than the sixteen in the embodiment of the invention shown in the drawings. As an example, if five partition members are provided for each group of partition members, then there will be twenty-five compartments.

If desired, attractive designs can be placed on the cloth fabric which makes up the partition members so that the panty hose storage device will be attractive in appearance.

In use, the panty hose storage device 10 is placed on the shelf of a dresser drawer and each compartment can receive an individual panty hose or other hosiery. By having each panty hose kept separately, the chances of snagging are minimized and the panty hose can be kept in a neat attractive fashion.

When it is no longer desired to use the panty hose storage device of the present invention, the same can be removed from the drawer shelf and by applying a force in the direction of arrows 18 and 20 shown in FIG. 5 the device will collapse into an essentially uniplaner structure, thereby occupying a minimum amount of space.

The flexible shape of the present invention allows the panty hose storage device to fit various size drawer and storage areas. Still further, if desired, the panty hose storage device can be cut and customized to fit the particular size drawer area the purchaser is using to store the panty hose. In the latter case, provisions would have to be made to prevent any unravelling of the fabric used to make the panty hose storage device.

It is to be appreciated that the panty hose storage device of the present invention compresses the panty hose, thereby maximizing the number of panty hose that can be stored in a given area. In addition, the sides of the panty hose storage device provide sufficient friction with the panty hose so that the panty hose remain in the compressed space.

It can thus be seen that a panty hose storage device is provided which will accomplish the objects of the present invention.

I claim:

1. In a panty hose storage device, a first group of flat partition members, said first group of partition members being made from a fabric that has been treated with a fabric stiffener, each partition member in said first group of partition members being identical to every other partition member in said first group of partition members, each partition member in said first group of partition members having a number of downwardly extending vertical cuts spaced along the length of each partition member, the number of said vertical cuts in each partition member being equal to the number of partition members in said first group of partition members, a second group of partition members equal in number to the partition members in said first group, said second group of partition members being made from a fabric that has been treated with a fabric stiffener, and second group of partition members each being identical to every other partition member in the second group of partition members and each including an upwardly extending vertical cut extending from the lower edge thereof with the number of vertical cuts in each partition member of the second group of partition members being equal to the number of partition members in said second group, each vertical cut in a partition member of one group of partition members cooperating with a vertical cut in a partition member of the other group of partition members so as to secure the first group of partition members to the second group of partition members and vice versa, and means for securing a portion of each partition member in the first group of partition members to a partition member in the second group of partition members and vice versa to define a plurality of panty hose compartments, compressed panty hose stored in at least some of said compartments, whereby said panty hose storage device can be placed on a dresser drawer shelf.

2. A panty hose storage device according to claim 1, wherein said securing means comprises glue.

* * * * *